United States Patent [19]

Jayne

[11] 4,218,888

[45] Aug. 26, 1980

[54] IMPACT DEVICE

[76] Inventor: Michael E. Jayne, 948 N. Pleasant St., Amherst, Mass. 01002

[21] Appl. No.: 11,108

[22] Filed: Feb. 12, 1979

[51] Int. Cl.[2] ..... F01B 29/08

[52] U.S. Cl. ..... 60/632; 60/635; 123/65 VB; 123/73 FA; 123/642

[58] Field of Search ..... 60/633, 632, 635; 123/73 E, 46 R, 46 SC, 73 FA, 65 VB, 148 BA

[56] References Cited

U.S. PATENT DOCUMENTS

| | | | |
|---|---|---|---|
| 1,082,341 | 12/1913 | Kerner | 123/65 VB |
| 1,518,983 | 12/1924 | Hyvernaud | 123/65 VB |
| 2,898,893 | 8/1959 | Rohrer et al. | 60/633 |
| 3,042,008 | 7/1962 | Liesse | 123/46 SC |
| 3,213,607 | 10/1965 | Neumeier | 60/632 |
| 3,948,238 | 10/1974 | Jamieson | 123/148 BA |
| 3,967,771 | 7/1976 | Smith | 60/633 X |
| 4,075,850 | 2/1978 | Nakazato et al. | 60/633 |

*Primary Examiner*—Wendell E. Burns
*Attorney, Agent, or Firm*—Ross, Ross & Flavin

[57] ABSTRACT

An automatic impact delivering device or tool of the internal combustion type having a self-contained fuel supply, wherein:

1. valving is an integral function of the piston;
2. a pre-compression chamber and a combustion chamber are provided in the same structure;
3. there is only one major moving part;
4. a spark plug is fired by an ignition means, the ignition means being movable to enable the operator to change the power output of the device by changing the compression ratio of the fuel and air mixture in the combustion chamber;
5. a fuel metering system is an integral part of the piston and cylinder, thus not requiring any additional moving parts; and
6. the device is loaded by a single spring disposed wholly internally thereof.

5 Claims, 9 Drawing Figures

IMPACT DEVICE

PRIOR ART STATEMENT

The following is a listing of the patents, publications or other information which the applicant believes to be the closest prior art of which he is aware:

U.S. Letters Pat. Nos.

2,898,893
3,042,008
3,213,607
3,948,238
3,967,771
4,075,850

A primary object of the invention is to provide a simple inexpensive, highly reliable and versatile automatic impact device or tool having a self-contained fuel supply for use in the field in any impact situation such as driving nails or the like where no external power source is available.

Another object is to provide such a tool not requiring a compressed air source.

THE DRAWINGS

DETAILED DESCRIPTION OF THE DRAWINGS

The impact tool consists primarily of four components: a main body 10, a driver 12, an ignition means 14, and a trigger assembly 15.

Figure 1:
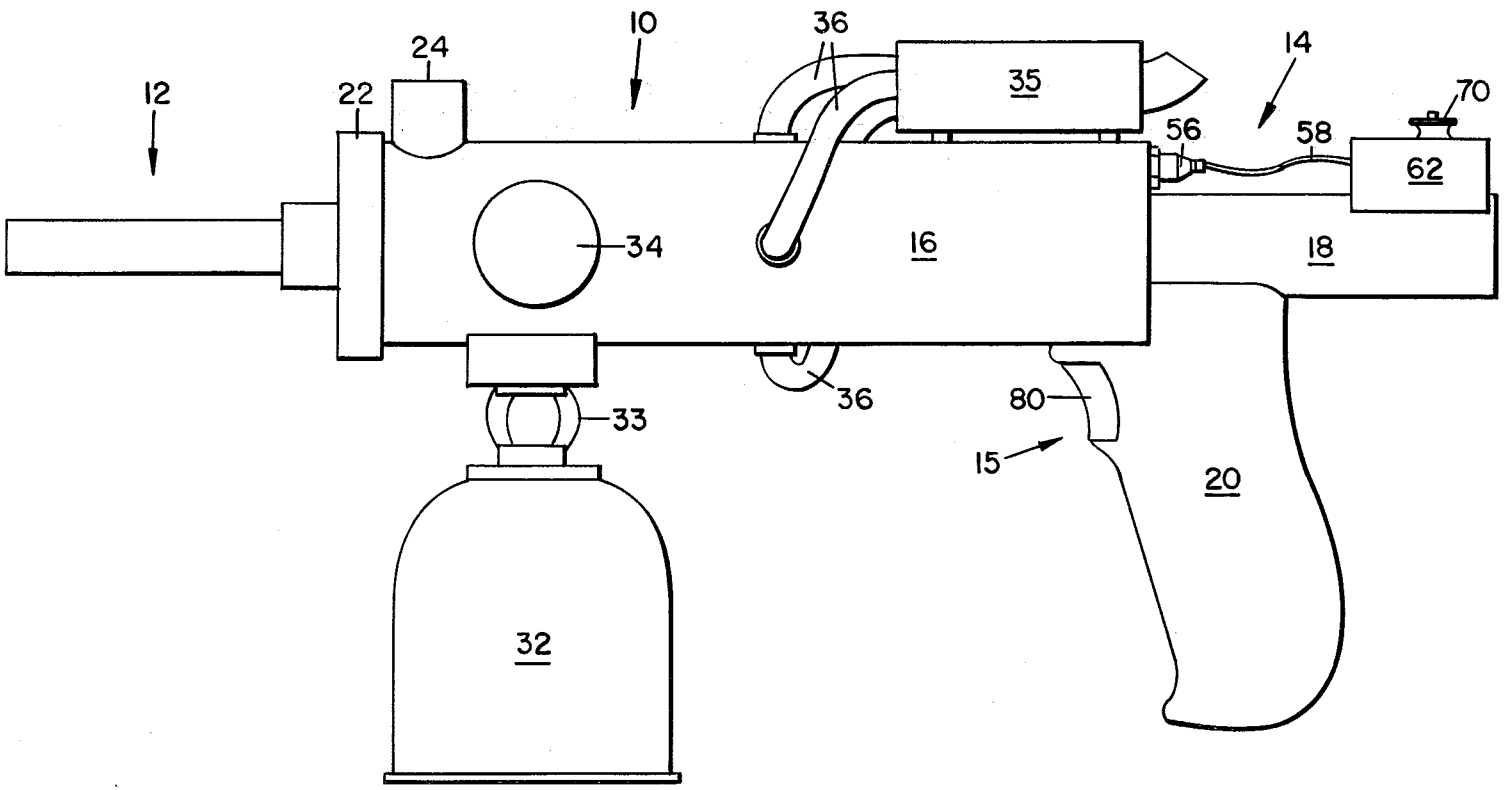
FIG. 1 is a side elevational view of an impact device embodying the invention.
Figure 2:
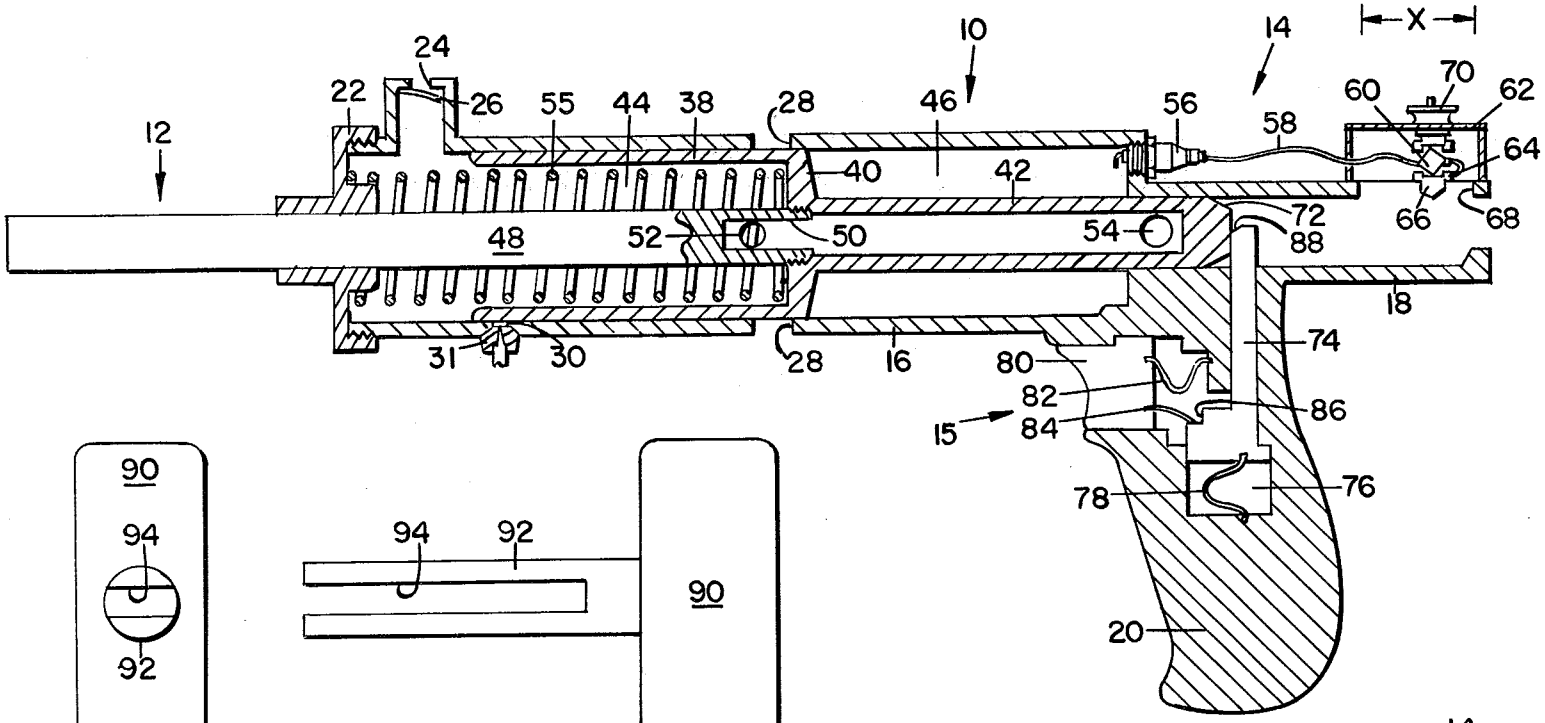
FIG. 2 is a longitudinal cross sectional view taken through the impact device of FIG. 1, with parts omitted for clarity.

Herefollowing, for purposes of orientation, the words "front" and "forward" will refer to the left as viewed in FIGS. 1 and 2, while the words "rear" and "rearward" will refer to the right as viewed in those Figures.

THE MAIN BODY 10

Main body 10 includes a longitudinally-extending large bore cylinder 16 having an integral, axially aligned small-bore cylinder 18 of lesser diameter than that of large bore cylinder 16 extending rearwardly therefrom.

An integral pistol-grip type handle 20 depends therefrom at the approximate juncture of the cylinders 16 and 18 adjacent the rear end of the tool.

Large bore cylinder 16 is partially closed at its front end by an end cap 22 threaded thereon.

An inlet port 24 controlled by a one-way reed check valve 26 is provided adjacent the forward end of cylinder 16 in the upper wall thereof and exhaust ports 28 disposed approximately centrally of the length of cylinder 16 are provided, all for purposes to be described.

A fuel supply port 30 is provided adjacent the forward end of cylinder 16 in the lower wall thereof, port 30 having a spray nozzle 31 threaded therein and being coupled to such as an aerosol butane bottle 32 or other fuel supply, there being a regulating or cut-off valve 33 disposed between the bottle and nozzle 31.

A second or forward handle 34 extends transversely outwardly from the exterior of the main body adjacent the forward end of the tool and a muffler 35 mounted on the main body is connected to exhaust ports 28 by lines 36.

THE DRIVER 12

Driver 12 includes a hollow piston 38 tightly sleeved by large bore cylinder 16, the piston being open at its forward end and closed at its rearward end by an end wall 40, the end wall having a centrally-disposed integral hollow piston shaft 42 extending rearwardly therefrom.

Piston shaft 42 is of appropriate diameter to be tightly sleeved by small bore cylinder 18 in rearward positions of the piston shaft.

End cap 22, piston 38, end wall 40 and piston shaft 42 of driver 12 effectively divide cylinder 16 into a precompression chamber 44 disposed forwardly of end wall 40 and a combustion chamber 46 disposed rearwardly thereof, all for purposes to be explained.

An impact rod 48 is disposed on the longitudinal central axis of the tool and has a forward portion extending outwardly from cylinder 16 through end cap 22 and a rearward portion threadedly engaged in end wall 40 of piston 38 and coaxially aligned with piston shaft 42.

A central recess 50 extends longitudinally into the rear end of impact rod 44 and opens into the hollow interior of piston shaft 42, while a transversely-extending port 52 in the rear end of the impact rod opens into the recess thereby providing for communication between precompression chamber 44 and the bore of piston shaft 42.

A transversely-extending port 54 adjacent the rear end of piston shaft 42 provides communication between the bore of the piston shaft and combustion chamber 46.

A compression spring 55 is sleeved by piston 38 and is captured within precompression chamber 44, abutting end cap 22 at its forward end and abutting the piston end wall 40 at its opposite end, the spring serving to urge driver 12 in a rearward direction.

THE IGNITION MEANS 14

Ignition means 14 includes a spark plug 56 disposed in a rear wall of cylinder 16 and extending into combustion chamber 46.

In a preferred form of the invention shown in FIGS. 1 and 2, a wire 58 connects the spark plug to a piezoelectric crystal 60 provided in a housing 62 disposed at the rear end of cylinder 18, crystal 60 serving to convert the mechanical energy of a sudden pressure exerted on it into a discharge of electricity as will appear.

Crystal 60 is mounted within housing 62 in a crystal assembly 64 having a contact member 66 in the form of a protrusion extending downwardly from the housing through a provided opening 68 in the upper wall of cylinder 18 into the cylinder interior.

The position of contact member 66 within cylinder 18 is adjustable, with the crystal assembly 64 and crystal 60 being slidable longitudinally relative to housing 62 for the distance X and adapted to be locked in preset position as by a thumb screw 70.

Contact member 66 extends into the interior of cylinder 18 a sufficient distance to be contacted by a bevelled surface 72 on the rear end of piston shaft 42 of driver 12 as the driver moves rearwardly.

The distance traversed by the driver before a spark is triggered at spark plug 56, (and therefore the compression ratio) is determined by adjusting the position of the crystal assembly relative to housing 62.

Figure 5:
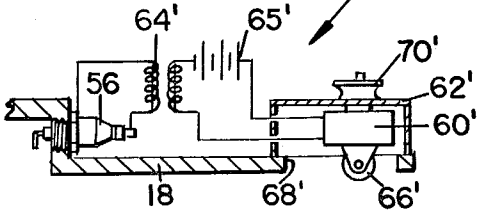
FIG. 5 is a fragmentary cross-sectional view of a modified form of ignition means.

In a modified form of the invention shown in FIG. 5, spark plug 56 is connected to a microswitch 60' provided in a housing 62' disposed at the rear end of cylinder 18, with an induction coil 64' and a power source, such as a battery 65', being disposed between the spark plug and microswitch, as shown.

Microswitch 60' has a contact member 66' in the form of a wheel extending downwardly from the housing through a provided opening 68' in the upper wall of cylinder 18 into the cylinder interior.

The position of contact member 66' within cylinder 18 is adjustable, with the microswitch 60' being slidable longitudinally relative to housing 62' and adapted to be locked in preset position as by a thumb screw 70'.

Contact member 66' extends into the interior of cylinder 18 a sufficient distance to be contacted by bevelled surface 72 on the rear end of piston shaft 42 of driver 12 as the driver moves rearwardly.

The distance traversed by the driver before a spark is triggered at spark plug 56, (and therefore the compression ratio) is determined by adjusting the position of microswitch 60' relative to housing 62'.

THE TRIGGER ASSEMBLY 15

Trigger assembly 15 includes a vertically-extending sear 74 slidably disposed in a cavity 76 in handle 20, the sear being releasably supported in a raised position wherein its upper end is positioned in the interior of cylinder 18 and in contact with the rear face of piston shaft 42 by a leaf spring 78 extending between the bottom edge of the sear and the bottom wall of cavity 76.

When the device is idle, driver 12 is precluded from moving to the rear of cylinder 18 due to contact of sear 74 with the rear face of piston shaft 42.

A finger-engageable trigger 80 is mounted for horizontal sliding movement relative to handle cavity 76 and is spring loaded by a leaf spring 82 extending between a rear edge of the trigger and a wall of cavity 76.

A flat spring 84 extends rearwardly from the trigger and has a free end which is engageable in a notch 86 provided on the sear.

When trigger 80, normally held in a forward position by spring 82 is depressed, spring 84 secured to the trigger at one end and lodged in notch 86 of the sear 74 at the other end begins to force the sear to move in a downward direction. When a bevelled corner 88 of the sear passes below the rear edge of the piston shaft 42 and into contact with a beveled surface 72 thereof, the driver 12 under the great force of compression spring 55 begins to slide rearwardly, forcing the sear downwardly into handle cavity 76 so that the sear upper end is no longer positioned in the interior of cylinder 18, whereby the driver is permitted to move rearwardly into contact with contact member 66 or 66' of ignition means 14. As sear 74 is forced downwardly by the rearward movement of driver 12, the downward movement of notch 86 relative to spring 84 allows the spring to snap out of the notch. This frees the sear to move upwardly and catch the driver as soon as the latter moves forwardly.

The trigger mechanism is reset by releasing the trigger which permits spring 84 to snap back into notch 86 of the sear, the sear being urged upwardly into cylinder 18 by spring 78 once driver 12 returns to a forward position.

OPERATION OF THE TOOL

It will be recalled that the tool is divided into a pre-compression chamber 44 and a combustion chamber 46.

Inlet port 24 and reed check valve 26 permit the passage of air into the pre-compression chamber. The combustion chamber is open to exhaust ports 28 in cylinder 16 only when piston 38 of driver 12 has moved to a forward-most position. Port 54 in the hollow piston shaft 42 is sealed by the wall of the small bore cylinder 18 except when the driver has moved to a forward-most position, at which time the port 54 is opened to the combustion chamber 46 thereby permitting passage of air from the pre-compression chamber 44 to the combustion chamber 46.

In an idle or loaded state, as shown in FIGS. 2 and 5, driver 12 is held approximately four-fifths of the distance toward its forwardmost position by sear 74. Fuel-supply nozzle port 30 and exhaust ports 28 are closed off by the wall of piston 38, and pre-compression chamber 44 is closed off from combustion chamber 46.

Figure 6:
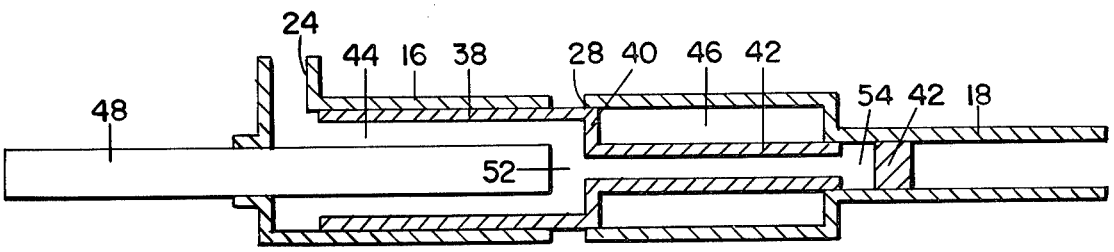
FIGS. 6–9 are schematic showings of the impact device in rest and use positions.
Figure 7:
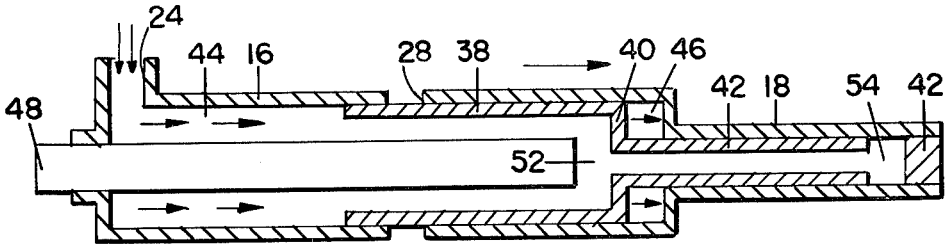

Combustion chamber 46 contains a fuel-air mixture. When trigger 80 is depressed, driver 12 begins to move rearwardly under the force of spring 55. As shown in FIG. 6, as piston 38 moves rearwardly it uncovers fuel supply port 30, whereupon spray-nozzle 31 sprays fuel into pre-compression chamber 44 in an amount proportional to the time port 30 remains uncovered. The increasing volume of the pre-compression chamber draws in exterior air through inlet port 24. Simultaneously the decreasing volume of the combustion chamber compresses the gases confined therein. When the end of piston shaft 42 impacts contact member 66 or 66' of ignition means 14 at the pre-set position, spark plug 56 is ignited thereby causing the gases in the combustion chamber to explode, thus reversing the direction of movement of driver 12 to the power stroke as shown in FIG. 7.

Figure 8:
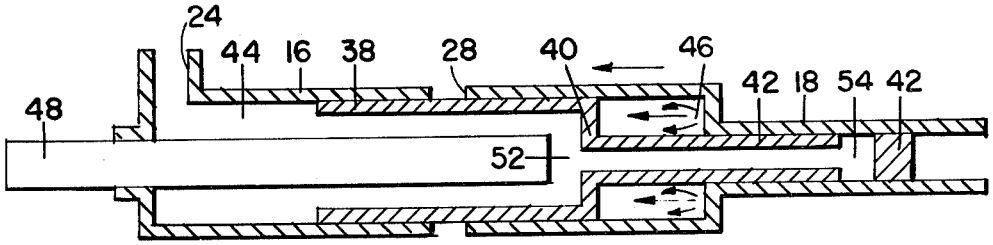
Figure 9:
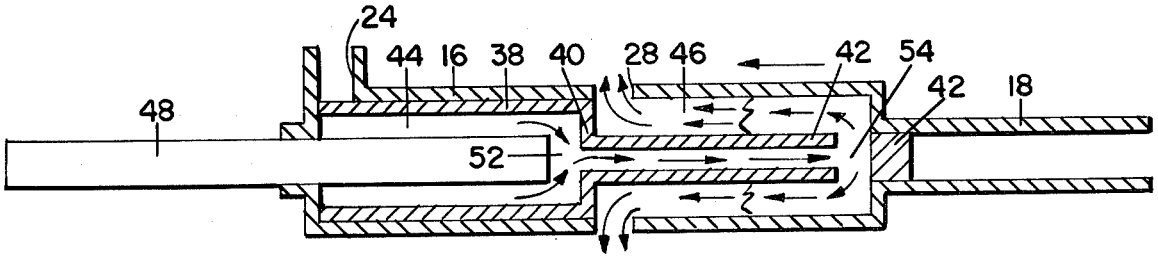

As the piston 38 of driver 12 moves forwardly in said reverse direction, energy of the exploding gases is harnessed in three ways: first, impact rod 48 is driven forwardly as shown in FIG. 8, delivering a sudden impact, this being the useful or output energy; second, spring 55 is compressed, storing energy for the next compression cycle; and third, the air in pre-compression chamber 44 now sealed by one-way reed check valve 26 is compressed to approximately half of its original volume. As driver 12 moves past its idle position, supply port 30 and spray nozzle 31 are closed off, and sear 74, cleared by piston shaft 42, springs up into the "catch" position. As driver 12 moves all the way forwardly, piston 38 moves forwardly of exhaust ports 28, thereby opening the exhaust ports to combustion chamber 46. Simultaneously, port 54 in hollow piston shaft 42 moves forwardly of the sealing small bore cylinder 18 into the combustion chamber, thus opening a passage from the pre-compression chamber. At this point the compressed fuel-air mixture in pre-compression chamber 44 pushes through port 52 and recess 50 in impact rod 48 through the hollow interior of piston shaft 42 and outwardly therefrom through port 54 into the rear of combustion chamber 46 forcing the exhaust gases out the forward exhaust ports 28. When driver 12 has lost momentum spring 55 forces it back against the sear 74 closing off ports 28 and 54.

Figure 3:
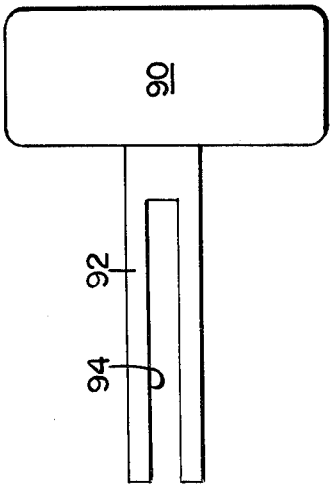
FIG. 3 is a side elevational view of a charging handle for manually loading the impact device.
Figure 4:
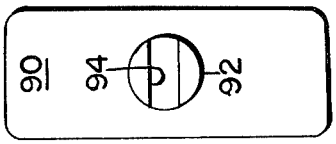
FIG. 4 is an end elevational view of the charging handle of FIG. 3.

Normally, the device remains loaded (i.e. with spring 55 compressed and with a fuel-air mixture in combustion chamber 46). However, after storage, or running out of fuel, it may be necessary to load the device manually. A charging handle 90, of the type shown in FIGS. 3 and 4 is provided for this purpose.

A cylindrical rod 92 of the charging handle is insertible into small bore cylinder 18 through a rear wall of the latter and into contact with the rear end of piston shaft 42, rod 92 being bifurcated as at 94 so as to provide a clearance for contact member 66 and sear 74.

Forward pressure on handle 90 moves driver 12 forwardly until sear 74 springs upwardly into cylinder 18 in a stop position rearwardly of the piston shaft.

I claim:

1. In an automatic impact delivering tool of the internal combustion type and having a self-contained fuel supply, the improvement comprising:

a body communicating with the fuel supply and with atmosphere, a driver within the body and dividing the body into a compression chamber and a combustion chamber, the driver including a piston having integral valving, fuel metering means integral with the body and driver, ignition means for igniting the fuel air mixture for moving the driver, and trigger means for actuating the driver.

2. In an impact delivering tool according to claim 1, wherein the ignition means is adjustable for changing the compression ratio of the fuel air mixture in the combustion chamber.

3. In an impact delivering tool according to claim 1, including a compression spring disposed wholly within the body for loading the driver,

4. In an impact delivering tool according to claim 1, wherein the ignition means comprises a piezoelectric crystal linked to a spark plug.

5. In an impact delivery tool according to claim 1, wherein the ignition means comprises a microswitch linked to a spark plug.

* * * * *